US007482987B2

(12) United States Patent
Komatsu et al.

(10) Patent No.: US 7,482,987 B2
(45) Date of Patent: Jan. 27, 2009

(54) FEEDING STRUCTURE OF ANTENNA DEVICE FOR MOTOR VEHICLE AND ANTENNA DEVICE

(75) Inventors: Satoru Komatsu, Wako (JP); Hiroshi Kuribayashi, Wako (JP); Hideaki Oshima, Minato-ku (JP); Hiroshi Iijima, Minato-ku (JP)

(73) Assignees: Honda Motor Co., Ltd., Tokyo (JP); Nippon Sheet Glass Company, Limited, Tokyo (JP)

( * ) Notice: Subject to any disclaimer, the term of this patent is extended or adjusted under 35 U.S.C. 154(b) by 75 days.

(21) Appl. No.: 11/290,694

(22) Filed: Nov. 30, 2005

(65) Prior Publication Data

US 2006/0139213 A1 Jun. 29, 2006

(30) Foreign Application Priority Data

Nov. 30, 2004 (JP) ..... 2004-346484
Sep. 16, 2005 (JP) ..... 2005-270317

(51) Int. Cl.
*H01Q 1/32* (2006.01)

(52) U.S. Cl. ..... 343/713

(58) Field of Classification Search ..... 343/713, 343/715, 700 MS, 850
See application file for complete search history.

(56) References Cited

U.S. PATENT DOCUMENTS

| | | | | | |
|---|---|---|---|---|---|
| 4,658,259 | A | * | 4/1987 | Blaese | 343/715 |
| 5,005,019 | A | | 4/1991 | Zaghloul et al. | |
| 5,448,250 | A | * | 9/1995 | Day | 343/700 MS |
| 5,471,222 | A | * | 11/1995 | Du | 343/713 |
| 5,633,645 | A | * | 5/1997 | Day | 343/700 MS |
| 6,054,961 | A | | 4/2000 | Gong et al. | |
| 6,329,950 | B1 | | 12/2001 | Harrell et al. | |

FOREIGN PATENT DOCUMENTS

| | | | |
|---|---|---|---|
| EP | 590 534 | A1 | 4/1994 |
| EP | 1 357 636 | A | 10/2003 |
| EP | 1 437 792 | A1 | 7/2004 |
| EP | 1 513 224 | A1 | 3/2005 |
| WO | WO 03/105278 | A1 | 12/2003 |

OTHER PUBLICATIONS

European Search Report dated Feb. 8, 2006, application No. EP 05 25 7376.

* cited by examiner

*Primary Examiner*—Michael C Wimer
(74) *Attorney, Agent, or Firm*—RatnerPrestia

(57) ABSTRACT

A feeding structure of an antenna device formed on a window glass panel of a motor vehicle is provided. A first feeding element opposing to the hot antenna element of the planar antenna and second feeding element opposing to the ground antenna element are located in the module mounted on the window glass panel so as to cover the planar antenna.

14 Claims, 14 Drawing Sheets

FEEDING STRUCTURE OF ANTENNA DEVICE FOR MOTOR VEHICLE AND ANTENNA DEVICE

BACKGROUND OF THE INVENTION

1. Field of the Invention

The present invention relates to a feeding structure of an antenna device formed on a window glass panel of a motor vehicle and an antenna device for a motor vehicle.

2. Related Art

Where an antenna for a band width of 1 GHz or more is formed on a window glass panel of a motor vehicle, it is desirable that the entire structure of an antenna device is implemented on the surface of a glass panel considering an antenna size. In this case, the antenna device is structured on one surface of a glass panel, because it is difficult to make a hole penetrating through the glass panel. An antenna formed on one surface of a glass panel is referred to as a planar antenna, one example thereof has been disclosed in Japanese Patent Publication No. 2004-214819.

Such planar antenna has been utilized for a Global Position System (GPS) antenna for receiving a signal designating a measured position from a GPS communication network for measuring the position of a motor vehicle utilizing an artificial satellite, a Dedicated Short Range Communication (DSRC) antenna utilized for a DSRC between a roadside radio equipment and a vehicle radio equipment, and an antenna for receiving a broadcast utilizing an artificial satellite or data delivered from various information service stations, for example.

In the planar antenna, the feeding point of the antenna is needed to be connected to an amplifier in a module through a coaxial feeder in order to operate an antenna device.

FIG. 1 shows a pattern of a planar antenna 8 which is composed of a hot antenna element 10 and a ground antenna element 12 surrounding the hot antenna element 10.

The hot antenna element 10 comprises an approximately rectangular opening 14 at a central portion, the outline of the hot element 10 being approximately rectangular. Two opposing corners on one diagonal line of the hot element 10 are cut away, respectively, to form perturbed portions 16*a* an 16*b*.

The ground antenna element 12 comprises a rectangular opening 18 of a central portion, the outline thereof being rectangular. The hot antenna element 10 is located in the opening 18, and the outer periphery of the hot antenna element 10 is separated from the inner periphery of the ground antenna element 12. The planar antenna 8 is formed by a conductive material on the surface of a window glass panel of a motor vehicle.

A cavity module including an amplifier therein is mounted so as to cover the planar antenna 8. The module has a box-like shape including an opening opposed to the planar antenna 8, the inner portion thereof comprising an electronic circuitry including an amplifier. The amplifier is connected to the feeding points of the hot and ground antenna elements 10 and 12 by a coaxial feeder. These two feeding points are shown by one feeding point 19 as a representative in the figure. The module also comprises a reflective plate to concentrate a radiated energy from the planar antenna toward one direction.

The inner conductor of the coaxial feeder is connected to the hot antenna element 10 at the feeding point 19, while the outer conductor thereof is connected to the ground antenna element 12 at the feeding point 19. While respective feeding points of the hot and ground elements are provided with terminals, the attachment of the terminal to the feeding point is difficult because the size of each of the terminals is small.

If a machine facility such as a robot is used for the attachment of a terminal, the manufacturing cost becomes high.

If the feeding point of the planar antenna 8 is directly connected to the amplifier in the module through a coaxial feeder, the module is not detachable from the planar antenna due to the presence of the coaxial feeder. To resolve this problem, a connector is inserted in the coaxial feeder between the feeding point of the planar antenna and the amplifier, resulting in the increasing number of components and the high cost.

In order to resolve above-described problems, a capacitive feeding method disclosed in Japanese Patent Publication No. 2004-535737 has been known in the art. According to this method, a conductive plate or electrode is located at a predetermined distance from the planar antenna, and a dielectric material is provided between the conductive plate and planar antenna to form a capacitive coupling therebetween. An electronic device (i.e., a high-frequency circuitry) is electrically connected to the conductive plate.

The capacitive coupling method described above has following problems.

1. The planar antenna is connected to a high-frequency circuitry through not a high-frequency lead but a planar electrode, so that an impedance matching to the planar antenna is difficult, which leads to a large transmission loss due to an impedance unmatching. As a result, it is required that a line connecting the planar electrode to the high-frequency is comparatively short.
2. The impedance matching is implemented by varying only the capacitance due to the simple capacitive coupling at the feeding portion. As a result, a degree of freedom for impedance matching at the feeding portion is low.
3. The larger the frequency, the smaller the size of an antenna element necessarily is. As a result, the size of the high-frequency circuitry becomes large compared to an antenna element. In such a condition, if the high-frequency circuitry integrated with the planar electrode is simply assembled at the periphery of the antenna element, then there is a fear of the distortion of an antenna radiation characteristic.
4. It is required for the simple capacitive coupling structure that the size of the planar electrode is made large or the distance between the planar electrode and the antenna element is made small in order to cause the capacitive impedance to be small. As a result, there is a fear of the occurrence of many problems in the manufacturing process.

The object of the present invention is, therefore, to provide a feeding structure of an antenna device for a motor vehicle in which a degree of freedom for regulating the impedance matching is increased, a transmission loss at the connection to the electronic circuitry, and a radiation characteristic of the planar antenna itself is not affected.

Another object of the present invention is to provide an antenna device for a motor vehicle comprising such a feeding structure.

SUMMARY OF THE INVENTION

A first feeding element and second feeding element are both located at a predetermined distance from feeding antenna. The feeding elements are capacitively coupled to the antenna elements. The feeding element are also located at the opening side of a module, and are connected to an electronic circuitry in the module through a feeder. In this manner, the feeder is not directly connected to the antenna elements, but directly connected to the feeding elements.

In this case, the factor such as the location, shape and size of the feeding element with respect to the antenna element are important. These factors are determined by a characteristic such as a voltage standing wave ratio (VSWR) at a feeding portion or indirect coupling portion.

The impedance of the antenna side viewed from the feeding elements is a composite impedance of the impedance of the antenna elements and the impedance of the indirect coupling portion. Therefore, it is possible to obtain a desired impedance of the antenna side viewed from the feeding elements by regulating the impedance of the indirect coupling portion. There are three methods for regulating the impedance of the indirect coupling portion. The first one is to regulate the distance between the antenna element and feeding element, the second one is to regulate the area of the feeding element, and the third one is to insert a dielectric material between the feeding element and antenna element.

In the case that the area of feeding element is increased, the first feeding element is overlapped to not only a hot antenna element but also a ground antenna element, or the second feeding element is overlapped to not only a ground antenna element but also a hot antenna element, resulting in a large degree of freedom for regulating the impedance.

The present invention also adopts the feeding structure by means of a feeding element in the module having a cavity, so that not only the one-to-one coupling between the antenna element and feeding element is implemented, but also the coupling to a resonance electromagnetic field in the cavity of the module through the feeder may be implemented. Therefore, it is possible that the required antenna characteristic is acquired by means of a small-sized feeding element in comparison with the feeding structure without the coupling to the resonance electromagnetic field. In this case, it is preferable to utilize a twin-lead type feeder.

According to the present invention, the following advantageous effects are obtained.

1. The terminal attachment is not required, therefore the soldering to the terminal of the planar antenna is unnecessary.
2. The connector used in a conventional feeding structure is unnecessary, so that the number of components may be decreased, because a feeder connecting between the feeding elements and the electronic circuitry is integral with the module.
3. The antenna device may be implemented easily by mounting the module to the planar antenna provided on the window glass panel.
4. A high-frequency transmission line such as a coaxial feeder or twin-lead type feeder is used for the feeder connected to the electronic circuitry (i.e., the high-frequency circuitry) including an amplifier, so that a stable signal transmission to the high-frequency circuitry is possible even if the feeder is long.
5. The feeding elements are located in the module, so that the antenna radiation characteristic is not affected even if a large-sized feeding element is used, because there is no obstacle in the main radiation direction (i.e., opposite direction to the module) of the planar antenna.
6. The size of the feeding element may be small by using a transmission line such as a twin-lead type feeder which is capable of coupling to an electromagnetic field in the module, because the transmission line is coupled to the feeding element through the electromagnetic field.

BEST MODE FOR CARRYING OUT THE INVENTION

An embodiment of a feeding structure of an antenna device according to the present invention will now be described with reference to the drawings.

Figure 2A:
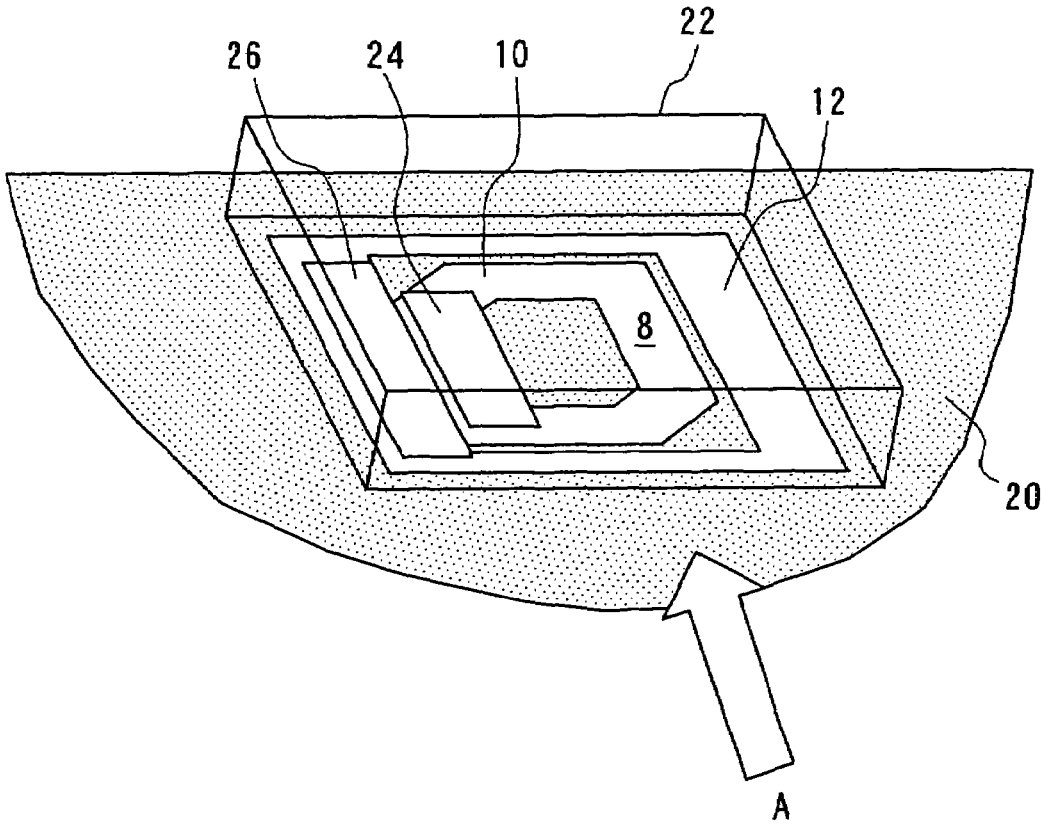
FIG. 2A shows a perspective view of a feeding structure according to the present invention.
Figure 2B:
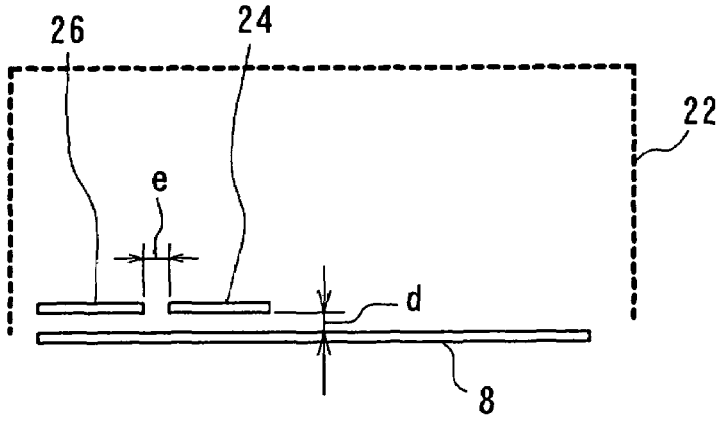
FIG. 2B shows a schematic side view in a direction designated by an arrow A in FIG. 2A.

FIGS. 2A and 2B show a fundamental structure of a capacitive coupling feeding structure according to the present invention. FIG. 2A is a perspective view and FIG. 2B a schematic side view in a direction designated by an arrow A in FIG. 2A.

In the figure, reference numeral 20 shows a window glass panel. On one surface of the glass plate, there is provided the planar antenna 8 illustrated in FIG. 1. A cavity module 22 is mounted so as to cover the planar antenna 8, the module being shown only by a dotted-line for simplifying the drawing.

The module 22 has a box-like shape including an opening opposed to the planar antenna 8, an electronic circuitry including an amplifier (not shown) being provided therein.

One Example of a Feeding Element

Two feeding elements 24, 26 are provided opposing to the planar antenna 8 in the module 22 with being integral thereto. These feeding elements are formed by rectangular electrodes consisting of a conductive material.

In the example shown in FIGS. 2A and 2B, a feeding element 24 is opposed (i.e., overlapped) to the hot antenna element 10, and a feeding 26 is opposed (i.e., overlapped) to the ground antenna element 12. The feeding element 24 is capacitively coupled to the hot antenna element 10, and the feeding element 26 is capacitively coupled to the ground antenna element 12. The distance between each of the feeding element and the planar antenna is selected to be a predetermined value d as shown in FIG. 20. Air is present between each of the feeding element and the planar antenna.

The feeding elements 24 and 26 are arranged in parallel to each other across a predetermined gap e, and may be connected to an amplifier (not shown) in the module 22 through a feeding line.

In order to increase the capacitive coupling between the feeding element and the planar antenna, it is preferable that the distance therebetween is made small or the size of each feeding element is made large.

A preferable distance between the feeding element and the planar antenna, and a preferable size of the feeding element will now be described.

The distance between the feeding element and the planar antenna is determined based on the following reasons.

(1) Lower limit; the distance which is less affected by the variation of capacitance due to dew condensation and fog on a window glass panel, for example, 0.3 mm.

(2) Upper limit; the distance to acquire a necessary capacitance to establish an antenna capability, for example, 0.5 λ, λ being free-space wave length.

Figure 1:
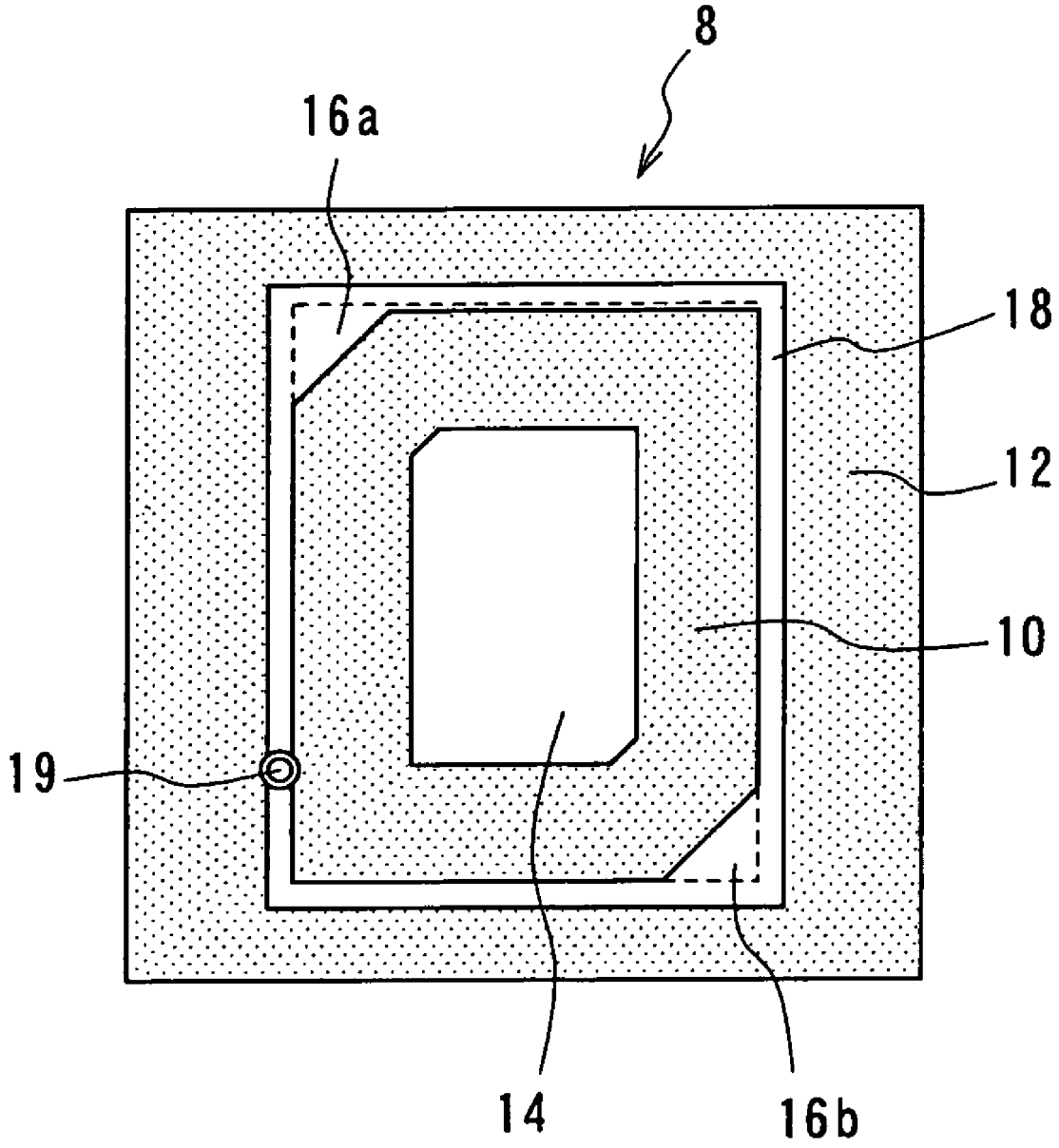
FIG. 1 shows a pattern of a planar antenna.
Figure 3A:
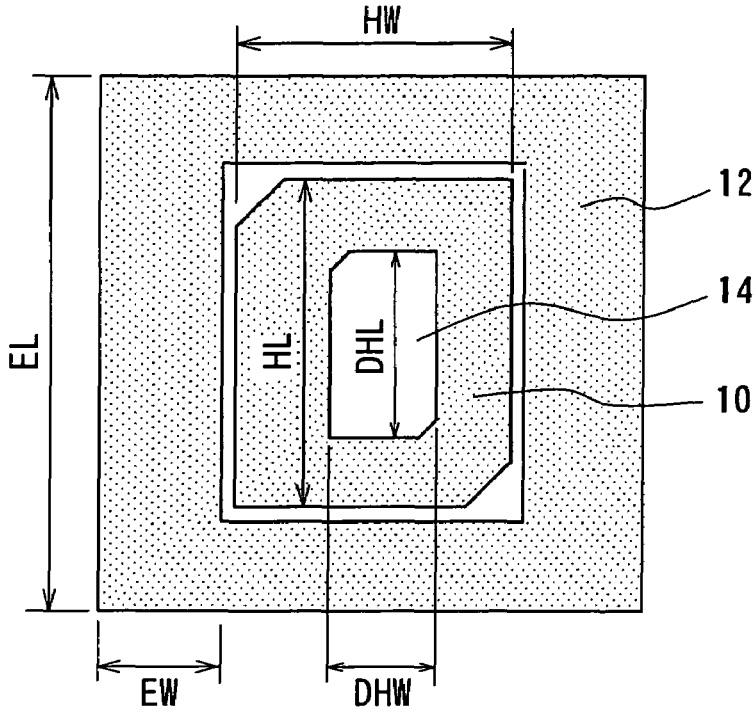
FIG. 3A shows a size representation of an antenna pattern for the planar antenna.

FIG. 3A shows a size representation of an antenna pattern for the planar antenna shown in FIG. 1. The length of the hot antenna element 10 is designated by HL, and the width thereof HW. The length of the ground antenna element 12 is designated by EL, and the width of one side thereof EW. The length of the approximately rectangular opening 14 of the hot antenna element 12 is designated by DHL, and the width thereof DHW. The following relationship among them is preferable $$0 \leqq DHW \leqq 0.8 \times HW$$

$$0 \leqq DHL \leqq 0.8 \times HL.$$

The reason why the respective upper limits are determined described above is to acquire a preferable coupling capacitance with the feeding element for realizing an impedance matching of a feeding portion.

Figure 3B:
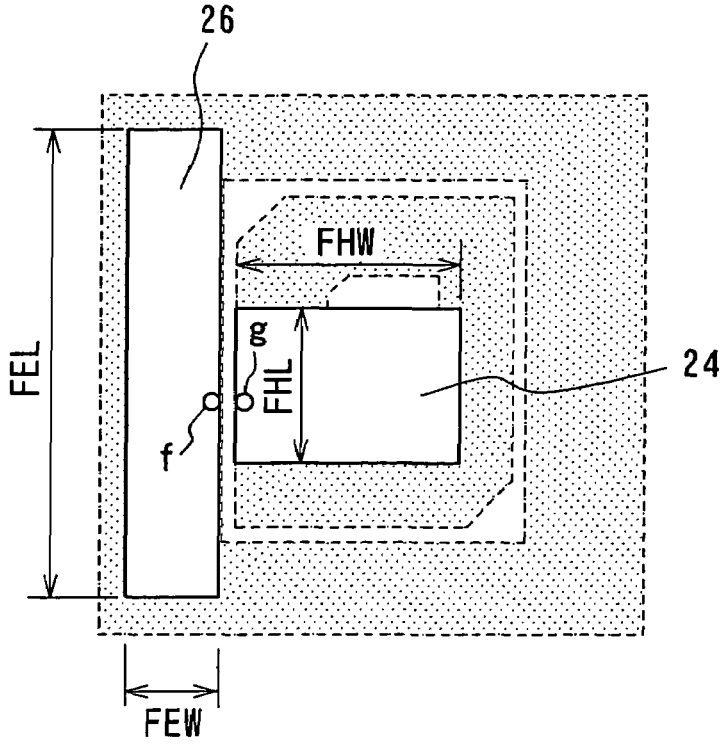
FIG. 3B shows a size representation of the feeding element.
Figure 4:
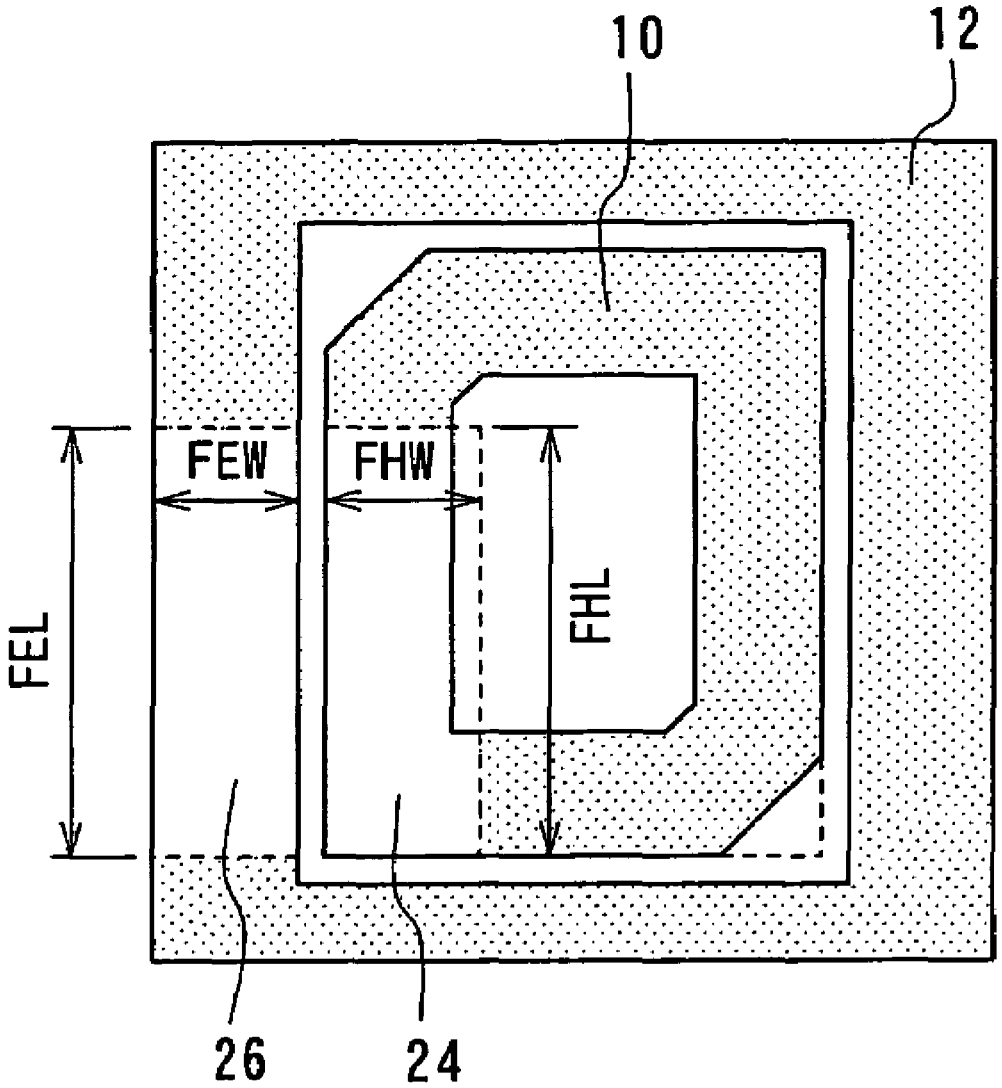
FIG. 4 shows a size representation of the feeding element.

FIG. 3B shows a size representation of the feeding element for the antenna pattern in FIG. 3A. The length of the feeding element 24 opposing to the hot antenna element 10 is designated by FHL, and the width thereof FHW. The length of the feeding element 26 opposing to the ground antenna element 12 is designated by FEL, and the width thereof FEW. In the figure, the ○ marks designated by f and g shows the feeding points, respectively. In the case that there is air between each feeding element and the planar antenna, it is preferable that the size of each feeding element has a following relationship with respect to the size of the antenna pattern $$0.5\ EL \leqq FEL \leqq EL$$

$$0.5\ EW \leqq FEW \leqq EW$$

$$0.3\ HL \leqq FHL \leqq HL$$

$$0.3\ HW \leqq FHW \leqq HW.$$

In the case that the feeding elements 24 and 26 are overlapped with only the corresponding hot and ground elements 10 and 12, respectively, the size of each antenna element with respect to that of the antenna pattern are preferably selected as described above. That is, the maximum values of the sizes FEL, FEW, FHL and FHW are EL, EW, HL and HW, respectively, and the minimum values thereof are 0.5 EL, 0.5 EW, 0.3 HL and 0.3 HW, respectively.

If the sizes FEL, FEW, FHL and FHW are smaller than the above-described minimum sizes, respectively, then enough coupling capacitance may not be obtained.

The results for the capability of the above-described method verified in fact by a simulation technique will now be described.

It was assumed that the sizes of the planar antenna were EL=0.4 kλ, EW=0.1 kλ, HL=0.3 kλ, HW=0.2 kλ, DHL=0.5×HL, and DHW=0.4×HW. Herein, k is a wave length shortening factor due to a glass panel, and λ is a free-space wave length.

Five types A, B, C, D and E of feeding elements having various sizes were prepared as shown in the Table 1.

TABLE 1

| | FHW | FHL | FEW | FEL | Determination |
|---|---|---|---|---|---|
| Type A | 0.30 HW | 0.38 HL | 0.93 EW | 0.27 EL | Bad |
| Type B | 0.30 HW | 0.45 HL | 0.93 EW | 0.38 EL | Bad |
| Type C | 0.30 HW | 0.68 HL | 0.93 EW | 0.48 EL | Bad |
| Type D | 0.30 HW | 0.83 HL | 0.93 EW | 0.97 EL | Good |
| Type E | 0.49 HW | 0.83 HL | 0.93 EW | 0.97 EL | Good |

The sizes FHW, FHL, FEW and FEL show the length and width of each of the rectangular feeding elements 24 and 26, respectively. The distance between these feeding elements and the planar antenna was selected to be 0.005 λ.

Figure 5:
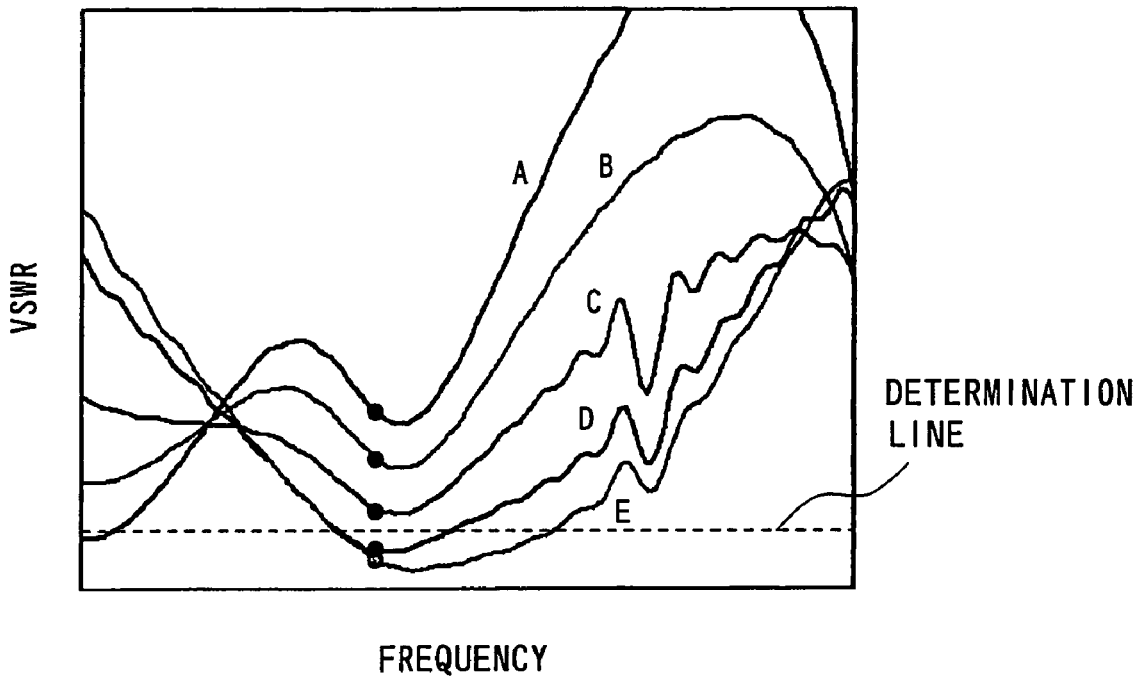
FIG. 5 shows VSWR based on a simulation method.

A simulation result for an antenna characteristic is shown in FIG. 5 in which the voltage standing wave ratios (VSWR) are plotted. In the figure, the characteristic graph for each model of Type A, Type B, Type C, Type D and Type E is designated by the alphabetical letter A, B, C, D and E, respectively.

In the antenna structure according to the present embodiment, a capacitor (i.e., a capacitive coupling portion) is deemed to be connected in series to the planar antenna, so that an antenna total impedance Z is represented as follows;

Z (the total impedance of the antenna)=$Z_A$ (the impedance of the antenna element)+$Z_C$ (the impedance of the capacitive coupling portion). Herein, the impedance of the antenna element means the impedance for the case that the terminal is directly attached to the antenna element.

In FIG. 5, the VSWR characteristic at a resonance frequency of an antenna (the point marked by ●) for Type D and Type E are lower than a determination line, so that it is appreciated that a good impedance matching is realized for type D and type E. It is desirable, therefore, that the size of the feeding element is designed so as to be smaller than that of the antenna pattern in order to realized a good antenna characteristic.

Figure 6:
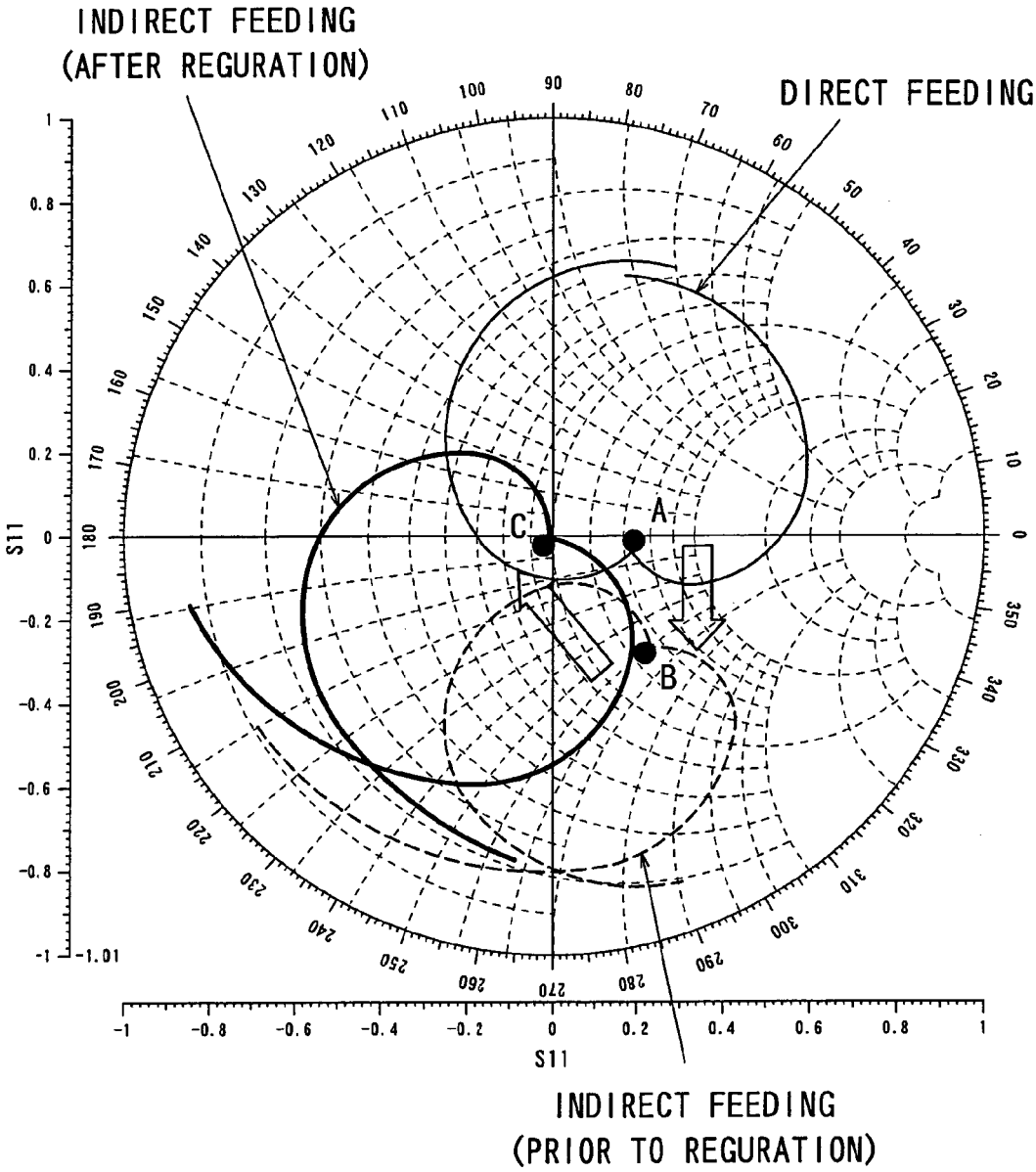
FIG. 6 shows Smith chart for illustrating an impedance regulation by a capacitive feeding.

The feeding element has an impedance regulation function, which is proved by the Smith chart shown in FIG. 6. The Smith chart includes the example which is directly fed to the antenna elements for comparison. In the figure, the feeding by a capacitive coupling is referred to as an indirect feeding in the sense that the planar antenna is indirectly fed through a capacitor, in comparison with the direct feeding in which a feeder line is directly connected to the planar antenna. In the Smith chart, the points A, B and C designate the point of resonance frequency in each antenna, respectively.

The impedances at the direct feeding and indirect feeding are different, so that the resonance impedance at the direct feeding (the point A) is changed to the point B which has a capacitive impedance at the indirect feeding, and then the resonance impedance is moved to the point C by properly regulating the feeding element. It is appreciated that a suitable impedance matching is established. It is, therefore, understood that the feeding element has a function of impedance regulation.

In order to increase a capacitive coupling between the feeding element and the antenna element, a dielectric material of high dielectric constant may be provided therebetween.

Figure 7:
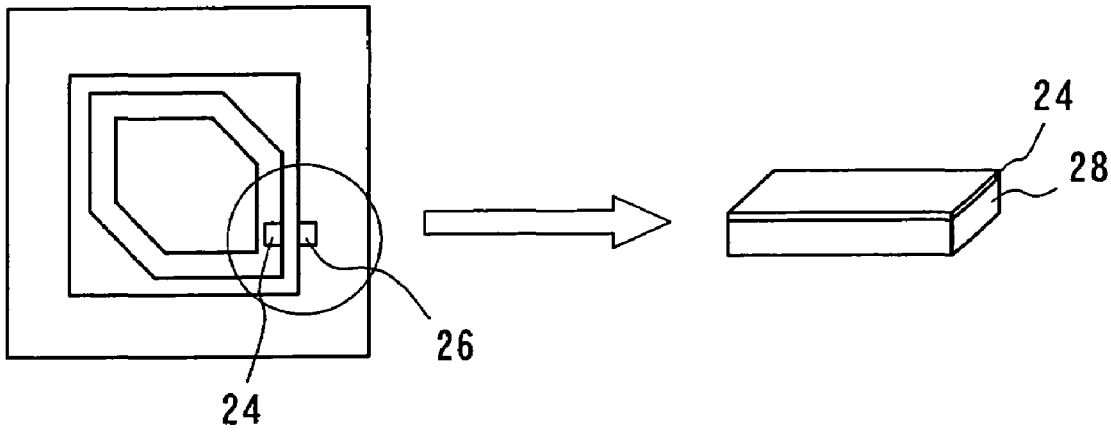
FIG. 7 shows an example in which a dielectric material of high dielectric constant is located between the antenna element and feeding element.

FIG. 7 shows the feeding element 24 and 26, and the shape of a dielectric material. The figure on the right side in FIG. 7 shows representatively a dielectric material 28 of high dielectric constant provided on the feeding element (i.e., electrode) 24. The size of the dielectric material located on the feeding element 26 is the same as that on the feeding element 24. These dielectric materials are integrally incorporated in the module, so that the surface of each of the dielectric materials contacts to the surface of the planar antenna.

Another Example of a Feeding Element

A degree of freedom for an impedance regulation function may be increased by overlapping a feeding element with not only the hot antenna element but also the ground antenna element.

Figure 8:
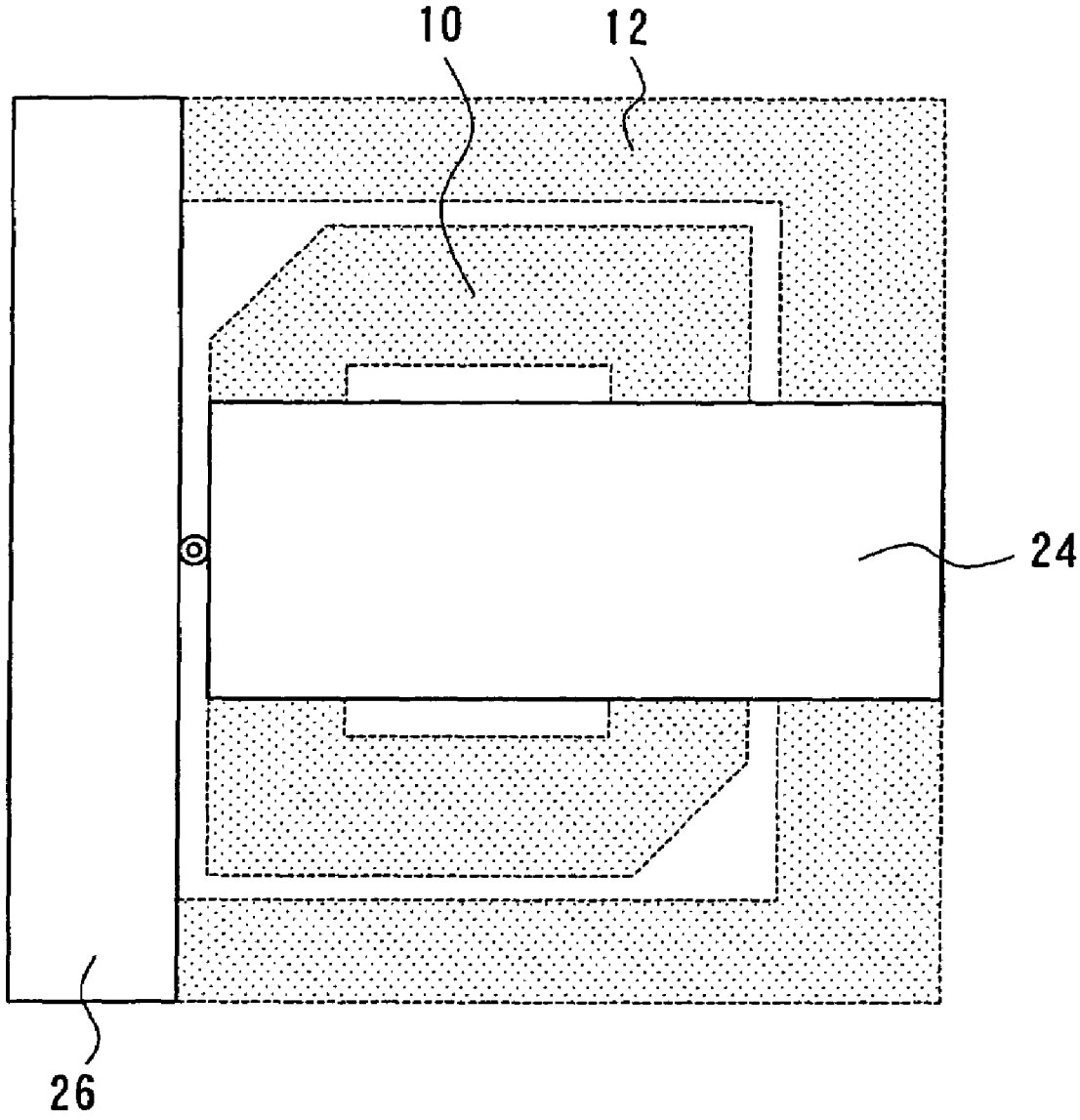
FIG. 8 shows another example of a feeding element.

According to an example shown in FIG. 8, the feeding element 24 is overlapped with not only the hot antenna element 10 but also the ground antenna element 12. The total impedance Z of the antenna is represented by Z=Zhh+ZaxZhe/(Za+Zhe)+Zee. Herein, Zhh is a coupling impedance between the feeding element 24 and the hot antenna element 10, Za is an impedance of the antenna element, Zhe is a coupling impedance between the feeding element 24 and the ground antenna element 12, and Zee is a coupling impedance between the feeding element 26 and the ground antenna element 12. By providing the overlapped portion between the feeding element 24 and the ground antenna element 12, the number of parameters to determine the total impedance of the antenna is increased, resulting in a large degree of freedom for regulating the total impedance.

On the contrary, the structure disclosed in Japanese Patent Publication No. 2004-535737 has a small degree of freedom for regulating the total impedance, because the impedance Zc of the capacitive coupling portion is substantially based on a pure capacitance component.

Figure 9:
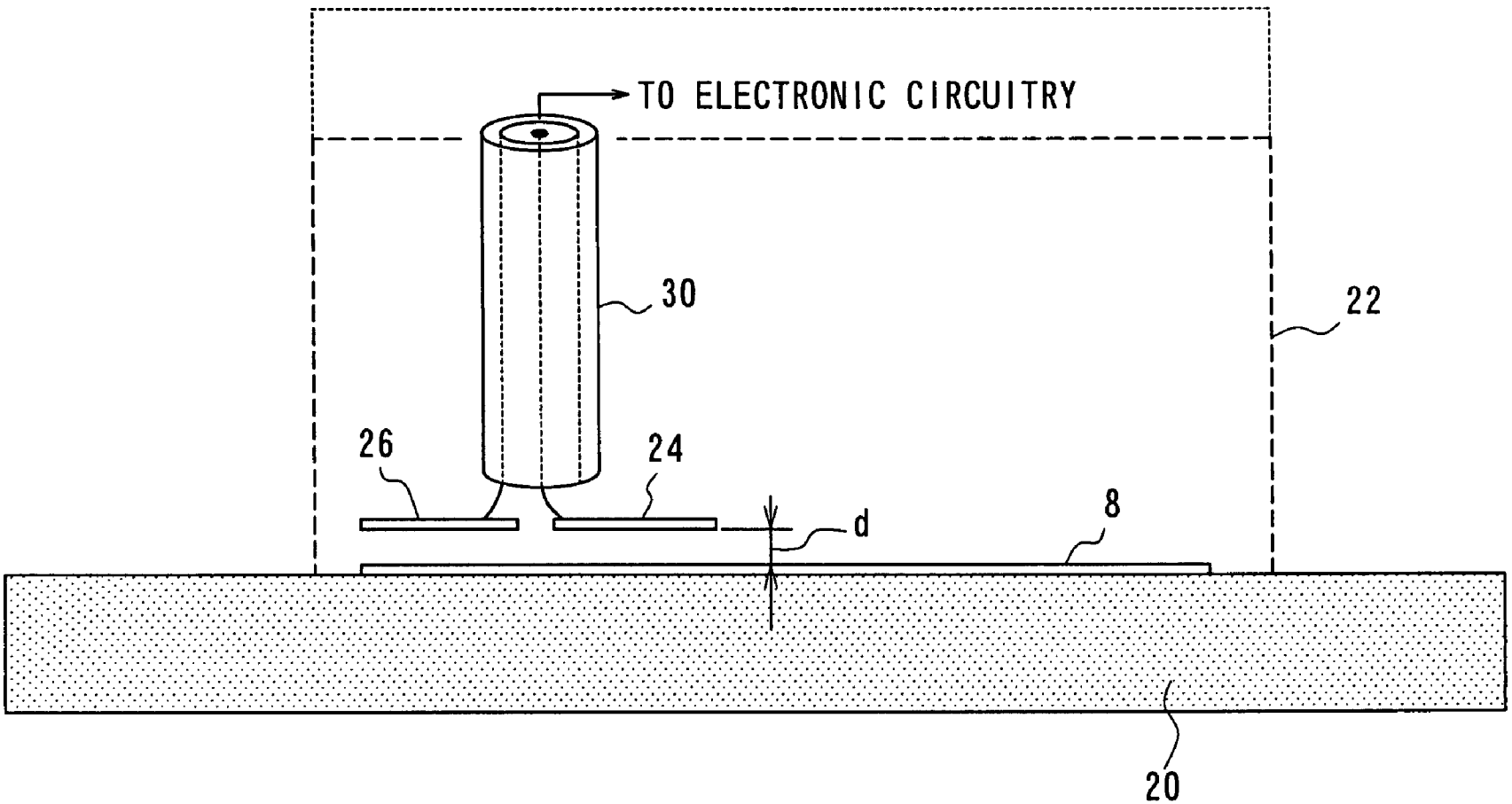
FIG. 9 shows an example in which a coaxial feeder is used.

FIG. 9 shows the structure for connecting the feeding elements 24 and 26 in FIG. 8 to an electronic circuitry including an amplifier (not shown) using a coaxial feeder 30. The inner conductor of the coaxial feeder 30 is connected to the hot antenna element 24, and the outer conductor thereof is connected to the ground antenna element 26. When a coaxial feeder is used as a feeder as described above, the effect of noise from the outer environment may be decreased.

While the feeding element 24 is overlapped with not only the hot antenna element 10 but also the ground antenna element 12 in the above-described example, the feeding element 26 may be overlapped with not only the ground antenna element 12 but also the hot antenna element 10 to increase a degree of freedom for an impedance regulation function.

Further Example of a Feeding Element

The size of a capacitive coupling feeding element may be small by coupling a feeder itself to an electromagnetic field within the module. As a feeder for this purpose, a coaxial feeder in which an inner conductor shielded by an outer conductor is not used, a transmission line such as a twin-lead type feeder which may be coupled to an electromagnetic field within the module.

Figure 10:
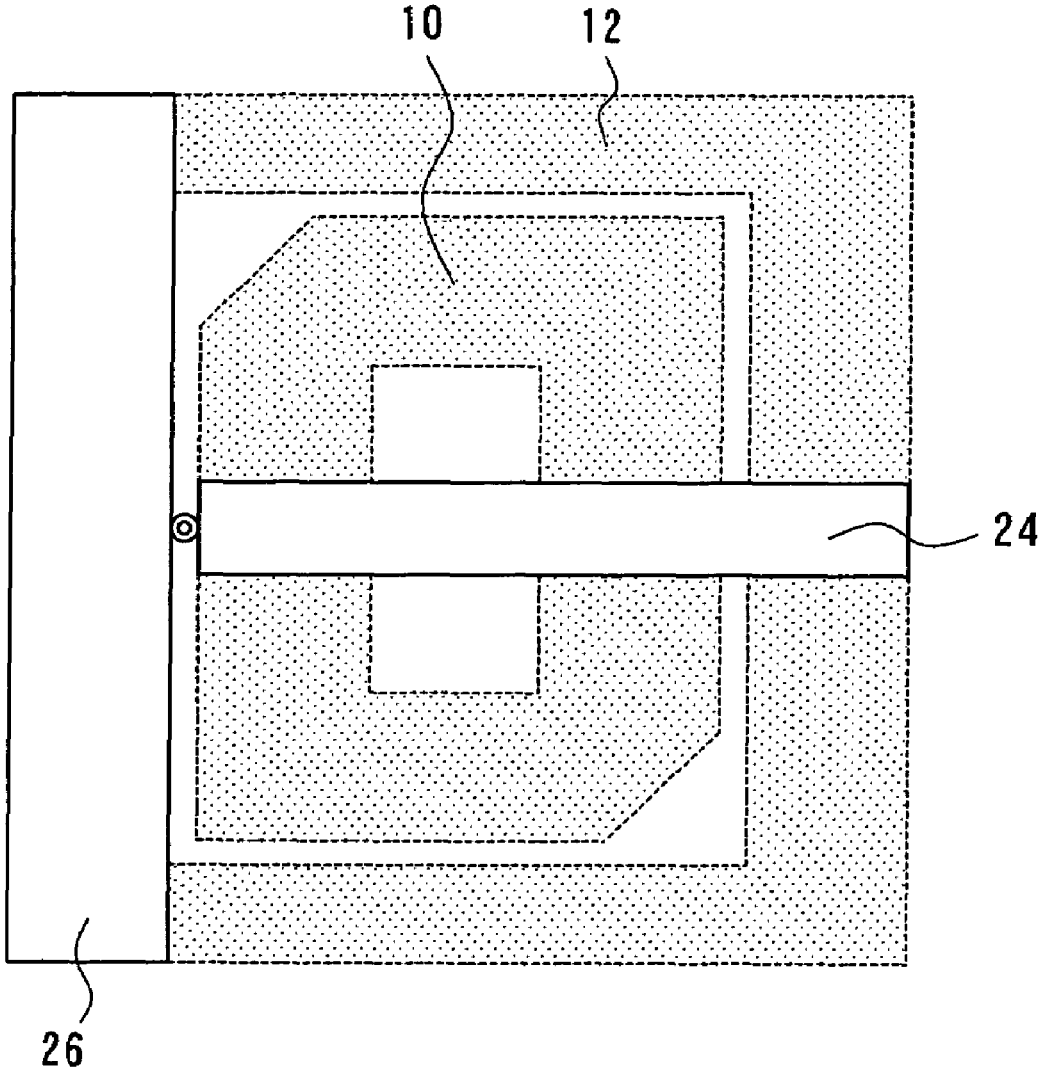
FIG. 10 shows a further example of a feeding element.
Figure 11A:
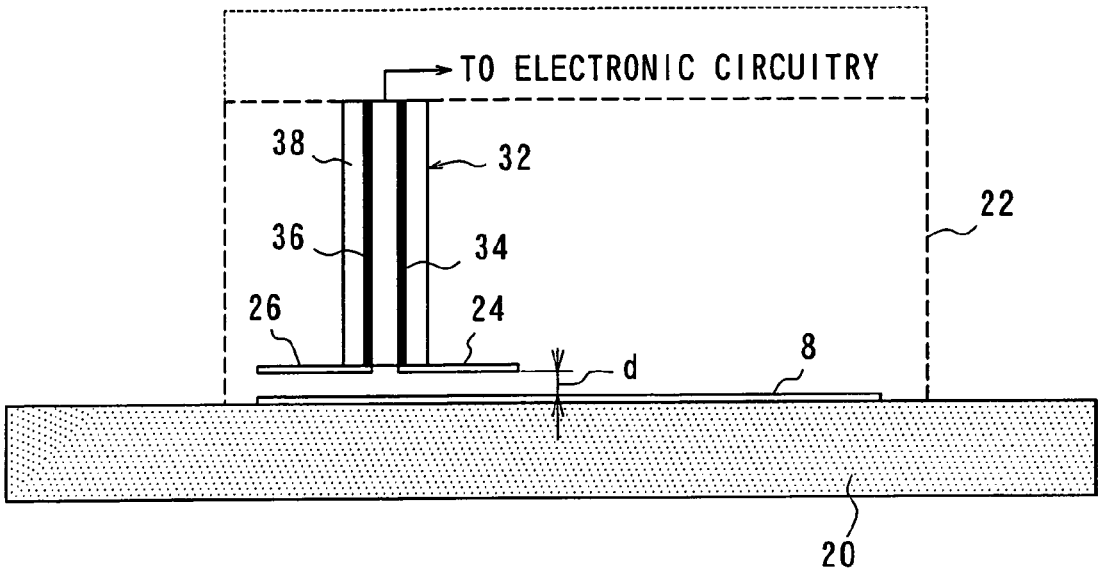
FIG. 11A shows an example in which a twin-lead type feeder is used.
Figure 11B:
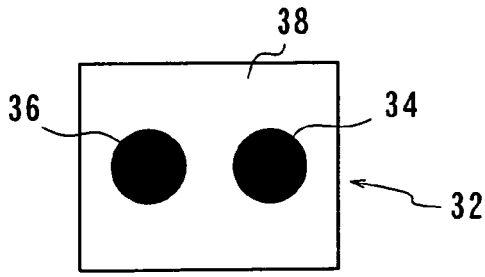
FIG. 11B shows a cross-sectional view of a twin-lead type feeder.

FIG. 10 shows an example of a small-sized feeding element. The feeding element 24 is overlapped with not only the hot antenna element 10 but also the ground antenna element 12. FIG. 11A shows the structure in which the feeding elements 24 and 26 in FIG. 10 are connected to an electronic circuitry through a twin-lead type feeder 32. The twin-lead type feeder 32 has a structure such that two parallel leads 34 and 36 are covered by a dielectric material 38. FIG. 11B is a cross-sectional view of the twin-lead type feeder 32.

The leads 34 and 36 of the feeder 32 connected to the feeding elements 24 and 26, respectively, are extended in the module 22 to be connected to the electronic circuitry (not shown).

The antenna device in accordance of the present invention has a structure such that an energy radiated from the planar antenna is concentrated toward one way direction by using the module. This means that an electromagnetic energy at a desired frequency band is stored in the cavity of the module.

Different from a coaxial feeder, the twin-lead type feeder does not have a structure such that a signal conductor is covered by a ground conductor. Therefore, the twin-lead type feeder couples the electromagnetic field in the cavity of the module. This means that the twin-lead type feeder is coupled to the antenna elements through the electromagnetic field. Furthermore, twin-lead type feeder capacitively couples to the antenna elements. As a result, the size of the feeding element may be small in comparison with the case in which a coaxial feeder is used.

Figure 12:
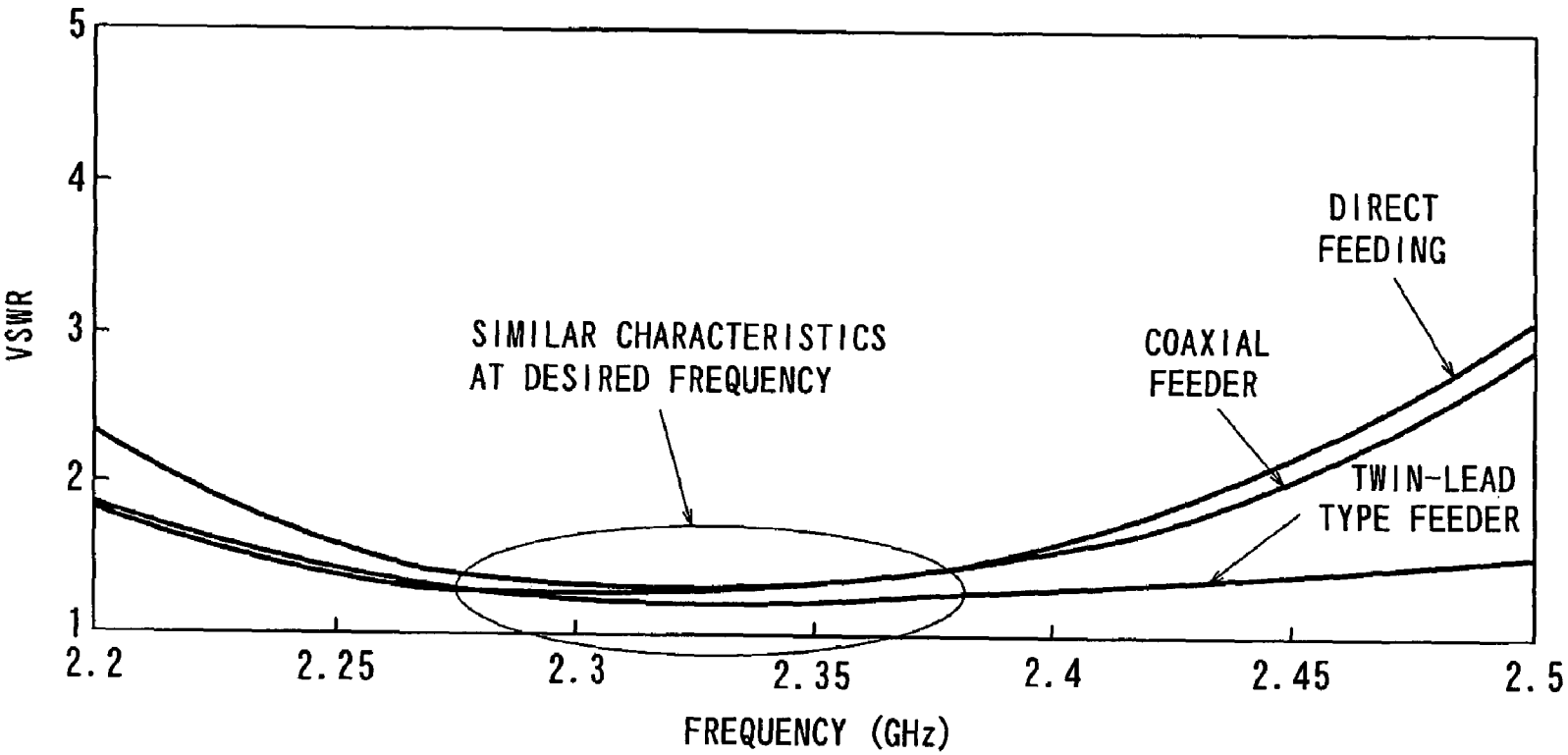
FIG. 12 shows VSWR characteristic.

The voltage standing wave ratios (VSWR) of the antenna devices using a coaxial feeder or twin-lead type feeder were measured. For comparison, the VSWR of the antenna device of direct feeding structure in which a coaxial feeder was directly coupled to the antenna elements of the planar antenna were also measured. FIG. 12 shows a measured result. It is appreciated that the similar VSWR characteristics are obtained at a desired frequency band.

It is also appreciated in FIG. 12 that the antenna device using the twin-lead type feeder has a flat VSWR characteristic and a VSWR value of nearly one, if considering the entire measuring frequency range. It is understood that the antenna device using a twin-lead type feeder could have a preferable impedance matching to a receiver at a brand-frequency band.

This is effective to an outer factor such as the vibration of a motor vehicle during traveling and an inner factor such as the dispersion of mounting dimension in manufacturing the antenna device.

Figure 13:
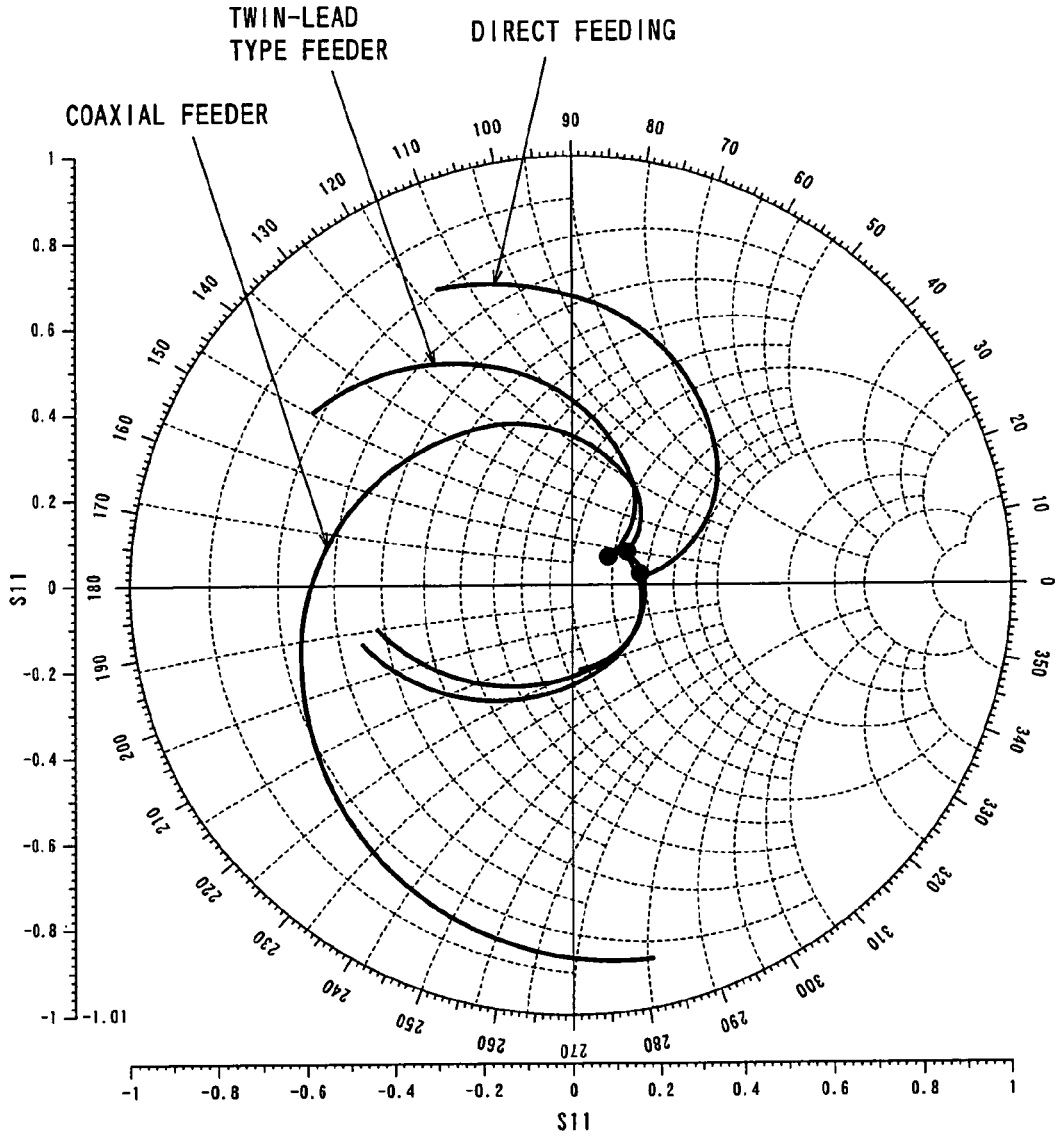
FIG. 13 shows an impedance characteristic.

The impedance characteristics of respective planar antennas using a coaxial feeder or twin-lead type feeder were measured. For comparison, the impedance characteristic of the planar antenna to which a coaxial feeder was directly connected was also measured. FIG. 13 shows a measured result. It is appreciated that an impedance matched to the input impedance an amplifier or receiver to which an antenna signal is inputted.

The most preferable range of the area of the type of feeding element illustrated in FIGS. 8 and 10 will now be described.

Figure 14:
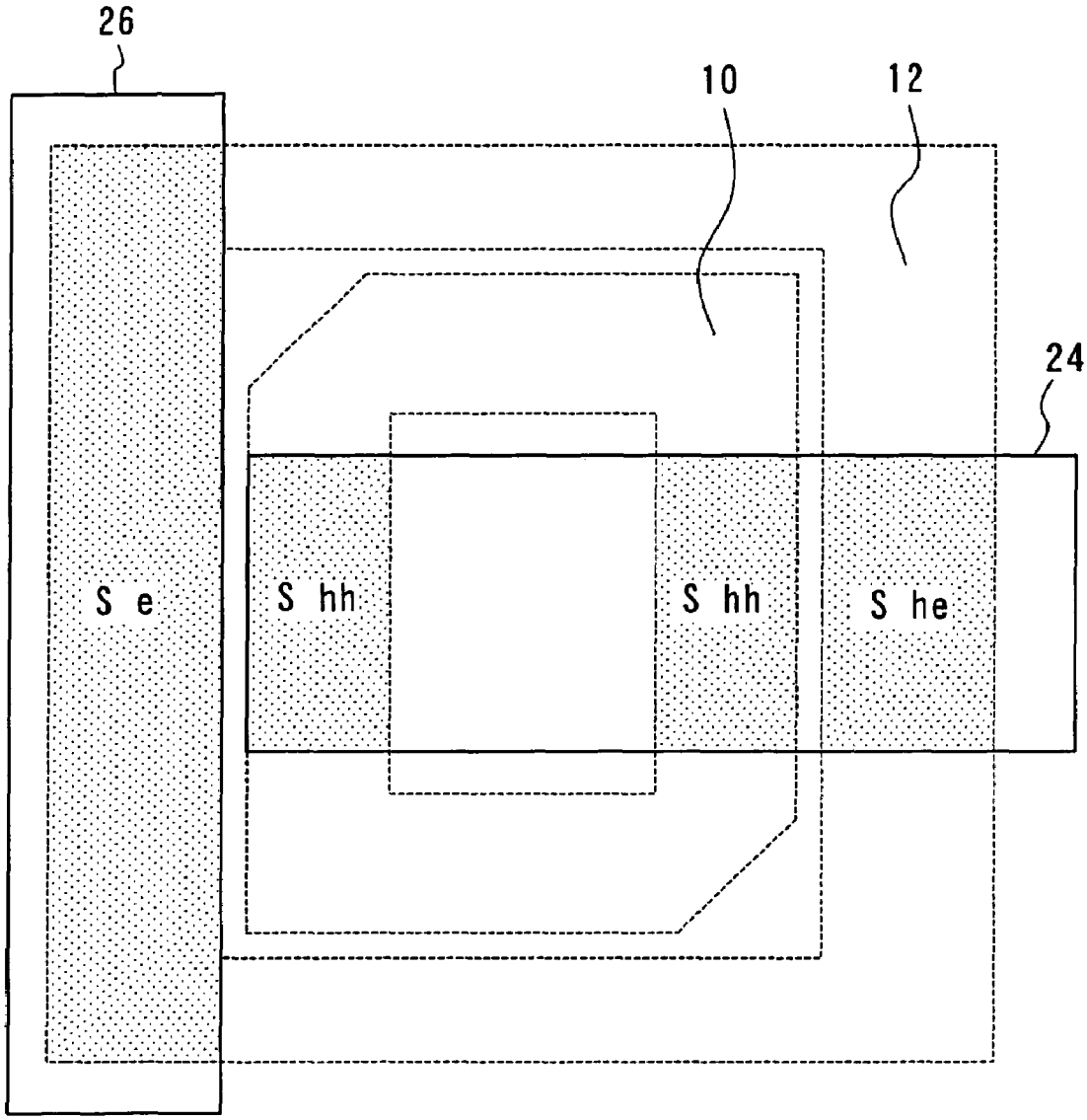
FIG. 14 shows the overlapped area of the feeding element to antenna element.

FIG. 14 shows the overlapped area of the feeding elements 24 and 26 to the hot antenna element 10 and ground antenna element 12. In the figure, Se designates the overlapped area of the feeding element 26 to the ground antenna element 12, Shh the overlapped area of the feeding element 24 to the hot antenna element 10, and She designates the overlapped area of the feeding element 24 to the ground antenna element 12.

The VSWR's in the cases that a coaxial feeder or twin-lead type feeder was used for the antenna device in FIG. 14 (the size of planar antenna thereof was the same as that in FIG. 8) were measured to obtain a desirable overlapped area. The obtained desirable overlapped area are as follows;

the case for a coaxial feeder $0<Shh<3\ Se$, more preferably $0.5Se<Shh<2.5Se$ $0<She<Shh$, more preferably $0<She<0.8Shh$ the case for a two-lead type feeder $0<Shh<Se$, more preferably $0<Shh<0.7Se$ $0<She<Shh$, more preferably $0<She<0.8Shh$.

According to the above-described overlapped area, the total impedance of the antenna device was nearly 50 Ω and the preferable VSWR was obtained.

Comparing a feeding via the coaxial feeder with a feeding via the twin-lead type feeder, the size of each feeding element in the case of the twin-lead type feeder is smaller than that in the case of the coaxial feeder. In other words, even if the coupling between the planar antenna and the feeding elements is small, a necessary antenna characteristic may be realized. Considering the frequency characteristic of the VSWR, both cases have an equivalent characteristic. This means that an electronic circuitry is simply connected to the planar antenna in the case of the coaxial feeder, the signal conductor thereof being shielded from the electromagnetic field in the module, on the contrary, the coupling of the antenna system including the planar antenna and the twin-lead type feeder to an electromagnetic field become large because the twin-lead type feeder may be coupled to the electromagnetic field in the module.

While the embodiments of the present invention have described for the planar antenna, a hot antenna thereof having an opening, the present invention may be applied to the planar antenna, a hot antenna thereof having no opening.

The invention claimed is:

1. A feeding structure of an antenna device for a motor vehicle for feeding a planar antenna including a hot antenna element and ground antenna element from a cavity module including an electronic circuitry, the module being mounted on one surface of a window glass panel for the motor vehicle so as to cover the planar antenna, comprising:

a first feeding element located in the module opposing to the planar antenna at a first predetermined distance therefrom; and a second feeding element located in the module opposing to the planar antenna at a second predetermined distance therefrom, wherein the hot antenna element and the ground antenna element are formed on the one surface of the window glass panel.

2. A feeding structure according to claim 1, wherein the first feeding element is opposed to the hot antenna element, and the second feeding element is opposed to the ground antenna element.

3. A feeding structure according to claim 1, wherein the first feeding element is opposed to the hot antenna element and ground antenna element, and the second feeding element is opposed to the ground antenna element.

4. A feeding structure according to claim 1, wherein the first feeding element is opposed to the hot antenna element, and the second feeding element is opposed to the ground antenna element and hot antenna element.

5. A feeding structure according to any one of claims 1-4, wherein a dielectric material is provided between the planar antenna and the first feeding element, and between the planar antenna and the second feeding element, respectively.

6. A feeding structure according to claim 5, wherein the dielectric material is a dielectric material of high dielectric constant.

7. A feeding structure according to any one of claims 1-4, further comprising;

a feeder for connecting the first and second feeding elements to the electronic circuitry.

8. A feeding structure according to claim 7, wherein the feeder is a coaxial feeder.

9. A feeding structure according to claim 7, wherein the feeder is capable of being coupled to an electromagnetic field in the module.

10. A feeding structure according to claim 9, wherein the feeder is a twin-lead type feeder.

11. An antenna device for a motor vehicle, comprising:

a planar antenna including a hot antenna element and ground antenna element formed on one surface of a window glass panel for the motor vehicle; and the feeding structure claimed in any one of claims 1-4.

12. A feeding structure according to claim 1, wherein the first predetermined distance and the second predetermined distance are a same distance.

13. An antenna device for a motor vehicle, comprising:

a feeding structure of an antenna device for a motor vehicle for feeding a planar antenna formed on one surface of a window glass panel for the motor vehicle from a cavity module including an electronic circuitry, the module being mounted on the window glass panel so as to cover the planar antenna, wherein the planar antenna includes a hot antenna having a approximately rectangular outline, two opposing corners on one diagonal line thereof forming perturbed portions, and a ground antenna element surrounding the hot antenna element, the feeding structure includes, a first feeding element located in the module opposing to the planar antenna at a predetermined distance therefrom, a second feeding element located in the module opposing to the planar antenna at a predetermined distance therefrom, and a feeder for connecting the first and second feeding elements to the electronic circuitry, a signal conductor thereof being a transmission line capable of coupling to the electromagnetic field in the module, and there are relationships $0<Shh<Se$ and $0<She<Shh$ among Shh, She and Se, wherein Shh is the overlapped area of the first feeding element to the hot antenna element, She is the overlapped area of the first feeding element to the ground antenna element, and Se is the overlapped area of the second feeding element to the ground antenna element.

14. An antenna device for a motor vehicle, comprising:

a feeding structure of an antenna device for a motor vehicle for feeding a planar antenna formed on one surface of a window glass panel for the motor vehicle from a cavity module including an electronic circuitry, the module being mounted on the window glass panel so as to cover the planar antenna, wherein the planar antenna includes a hot antenna having a approximately rectangular outline, two opposing corners on one diagonal line thereof forming perturbed portions, and a ground antenna element surrounding the hot antenna element, the feeding structure includes, a first feeding element located in the module opposing to the planar antenna at a predetermined distance therefrom, a second feeding element located in the module opposing to the planar antenna at a predetermined distance therefrom, and a coaxial feeder for connecting the first and second feeding elements to the electronic circuitry, there are relationships $0<Shh<3Se$ and $0<She<Shh$ among Shh, She and Se, wherein Shh is the overlapped area of the first feeding element to the hot antenna element, She is the overlapped area of the first feeding element to the ground antenna element, and Se is the overlapped area of the second feeding element to the ground antenna element.

* * * * *